US008499961B1

(12) United States Patent
Goldenberg et al.

(10) Patent No.: US 8,499,961 B1
(45) Date of Patent: Aug. 6, 2013

(54) EGG CADDY SYSTEM

(76) Inventors: Melvin Goldenberg, Shirley, NY (US); Judy Goldenberg, Shirley, NY (US)

( * ) Notice: Subject to any disclaimer, the term of this patent is extended or adjusted under 35 U.S.C. 154(b) by 0 days.

(21) Appl. No.: 13/525,906

(22) Filed: Jun. 18, 2012

(51) Int. Cl.
*B65D 1/24* (2006.01)

(52) U.S. Cl.
USPC ..... 220/508; 220/507; 220/628; 220/636

(58) Field of Classification Search
USPC ..... 220/507, 508, 17.1, 628, 636, 631; 206/521.1, 521.6, 521.7
See application file for complete search history.

(56) References Cited

U.S. PATENT DOCUMENTS

| | | | | | |
|---|---|---|---|---|---|
| 1,712,211 | A | | 5/1929 | Hanson et al. | |
| 2,134,908 | A | * | 11/1938 | Copeman | 206/521.7 |
| 2,333,181 | A | * | 11/1943 | Inman | 206/521.7 |
| 2,599,322 | A | | 6/1952 | Drain | |
| 2,647,678 | A | * | 8/1953 | Olson | 229/402 |
| 2,944,696 | A | * | 7/1960 | Effgen | 220/507 |
| 3,291,365 | A | * | 12/1966 | Koene | 206/521.7 |
| D211,513 | S | | 6/1968 | Brown et al. | |
| 3,446,201 | A | * | 5/1969 | More | 126/39 R |
| 3,748,007 | A | | 7/1973 | Mathias | |
| 3,899,161 | A | | 8/1975 | McGann, Jr. | |
| 5,076,438 | A | * | 12/1991 | Aronson | 206/557 |
| D356,192 | S | | 3/1995 | Wolff | |
| 5,518,309 | A | | 5/1996 | St-Pierre | |
| 6,082,841 | A | | 7/2000 | Smith et al. | |
| D483,228 | S | | 12/2003 | Sherr | |
| 7,150,166 | B2 | | 12/2006 | Braun et al. | |
| 2009/0173256 | A1 | | 7/2009 | LeMarr | |

* cited by examiner

*Primary Examiner* — Anthony Stashick
*Assistant Examiner* — Christopher McKinley

(57) ABSTRACT

An egg caddy system for holding eggs in an immobilized position featuring a base with a plurality of egg protrusions disposed in the top surface. The egg protrusions may be arranged in a linear fashion or in parallel sections or groups. A flange extends downwardly and perpendicularly from the bottom surface of the base and forms a T-shaped cross-section. The flange can be inserted between two surfaces such as countertops, sinks, and stoves.

19 Claims, 3 Drawing Sheets

(ISO View)

(Front View)

(Top View)

(Bottom View)

(In-use View)

(Alternative Embodiment)

EGG CADDY SYSTEM

BACKGROUND OF THE INVENTION

Many cooks find themselves replacing eggs after they have rolled off countertops or stoves. The present invention features an egg caddy system adapted to hold eggs in place. The system can be used on a counter or a stove. The system makes it easier for cooks to handle and store eggs, for example when storing eggs at room temperature.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-6, the present invention features an egg caddy system (100) for holding eggs (101) in place on a countertop or other surface. The system (100) of the present invention can make it easier for cooks to handle and store eggs. The system (100) may be configured to hold 6 eggs, 12 eggs, or any other desired number of eggs (101).

Figure 2:
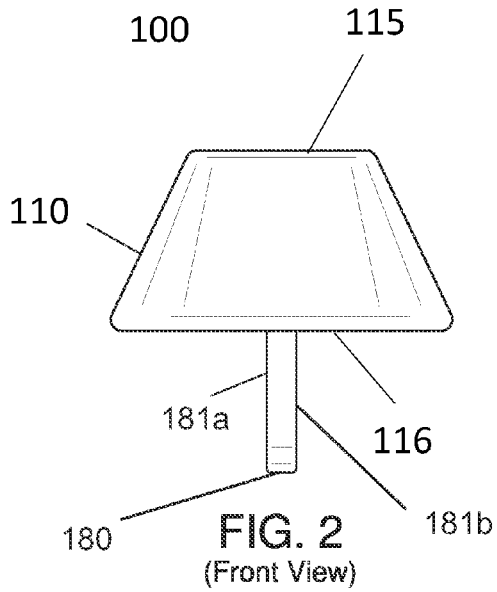
FIG. 2 is a front view of the system of the present invention.
Figure 3:
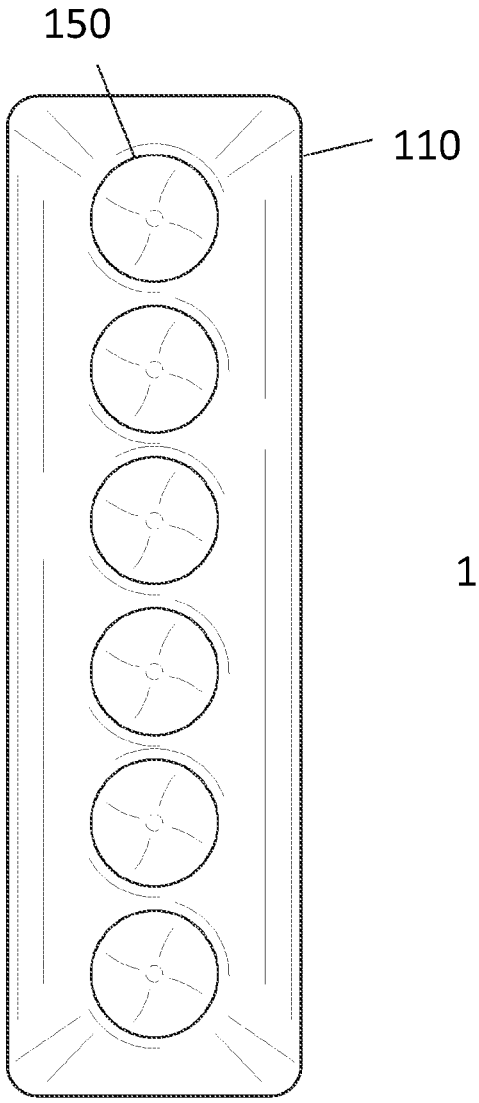
FIG. 3 is a top view of the system of the present invention.
Figure 4:
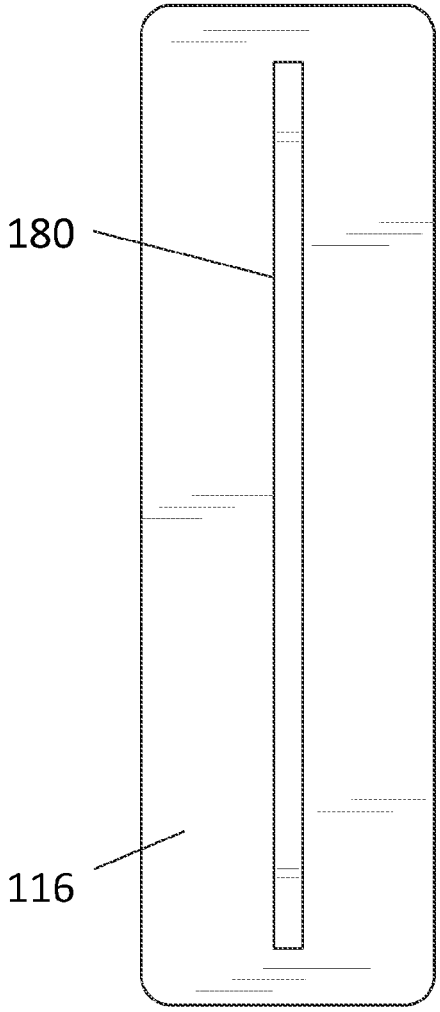
FIG. 4 is a bottom view of the system of the present invention.

The system (100) of the present invention comprises a base (110) that holds eggs (101). The base (100) has a first end (111), a second end (112), a top surface (115), and a bottom surface (116). As shown in FIG. 2, the base (110) may have a trapezoidal shape as viewed from the end, e.g., the first end (111) or second end (112). For example, the bottom surface (116) may have a width that is greater than that of the top surface (115).

Figure 5:
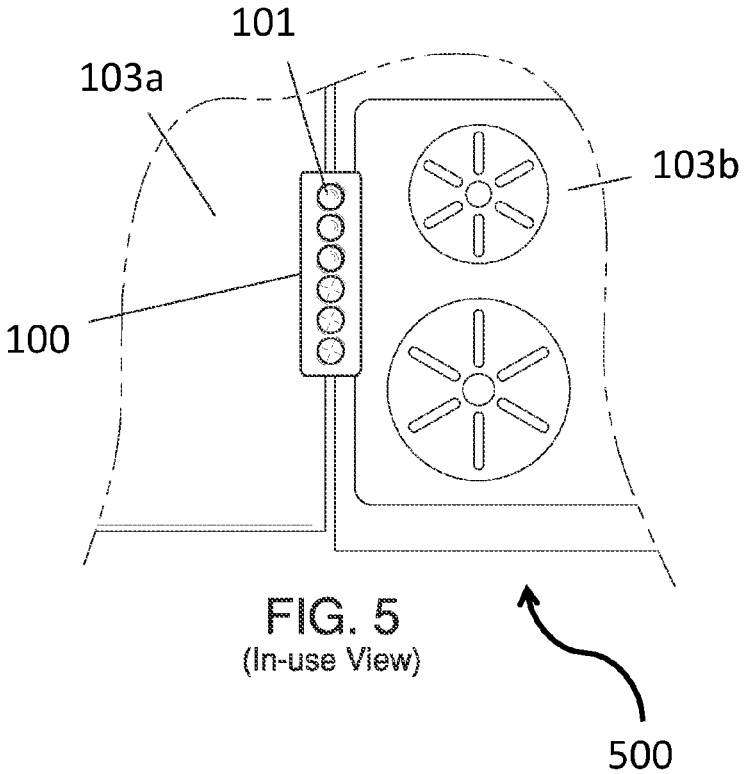
FIG. 5 is an in-use view of the system of the present invention.

A fixed and rigid flange (180) extends downwardly from the bottom surface (116) of the base (110) perpendicularly from the bottom surface (116). The flange (180) may extend the length of the base (110) (as measured from the first end to the second end) or a portion of the length of the base (110). Together, the bottom surface (116) of the base (110) and the flange (180) have a T-shaped cross-section as viewed from the first side (111) or the second side (112) of the base (110) (as shown in FIG. 2). As shown in FIG. 5, the flange (180) may be inserted (and sandwiched) between two surfaces (103), e.g., a first surface (103*a*) and a second surface (103*b*). The surfaces may include but are not limited to a countertop, a stove, a sink, etc. A first side (181*a*) of the flange has a height (as measured to the bottom surface of the base) that is identical to a height of a second side (181*b*) of the flange. The height of the fixed and rigid flange (180) being the same on either side allows the base (110) to remain horizontal when the flange (180) is placed between two surfaces (103*a*) and (103*b*), thus keeping the contents of the egg caddy from tipping out.

Figure 1:
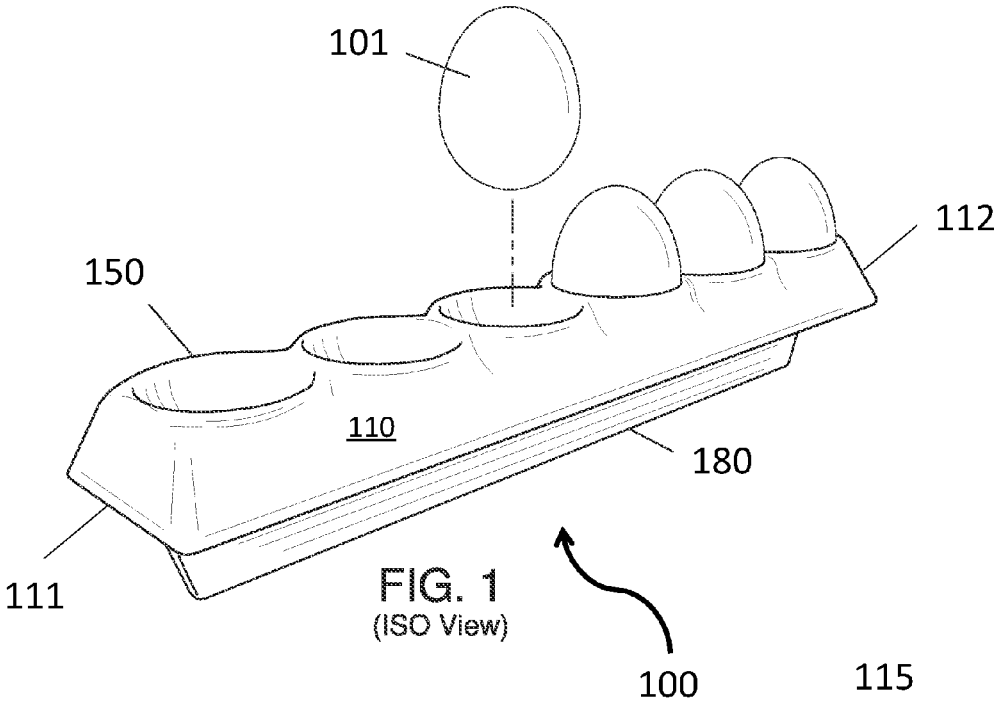
FIG. 1 is a perspective view of the system of the present invention.

A plurality of egg protrusions (150) is disposed in the top surface (115) of the base (110). The egg protrusions (150) are generally concave and are adapted to temporarily immobilize an egg (101) as shown in FIG. 1. The system (100) of the present invention may be constructed with various numbers of egg protrusions (150). For example, in some embodiments, the system (100) comprises at least two egg protrusions (150). In some embodiments, the system (100) comprises at least six egg protrusions (150). In some embodiments, the system (100) comprises at least twelve egg protrusions (150).

Figure 6:
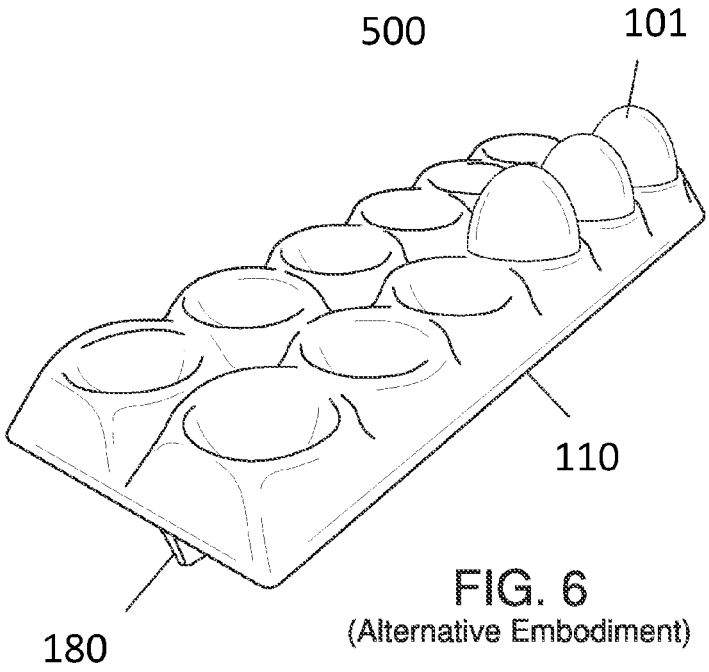
FIG. 6 is a perspective view of an alternative embodiment of the system of the present invention.

As shown in FIG. 6, in some embodiments, the system (100) comprises egg protrusions (150) that are arranged in two sections aligned parallel to one another (e.g., two sections of four protrusions, two sections of six protrusions, etc.). The system (100) of the present invention is not limited to this configuration and a single linear configuration. For example, in some embodiments, the system (100) comprises egg protrusions (150) that are arranged in three or more sections aligned parallel to one another (e.g., three sections of four protrusions, three sections of five protrusions, four sections of three protrusions, four sections of four protrusions, etc.).

The system (100) may be constructed in a variety of colors and designs and may be constructed from a variety of materials. For example, in some embodiments, the system (100) is constructed from a material comprising plastic, metal, the like, or a combination thereof. The system (100) is not limited to the aforementioned materials.

The present invention also features an egg caddy holding system (500) that includes the egg caddy system (100) and a pair of surfaces used to stabilize the egg caddy system (100). For example, the holding system (500) may comprise a first surface (103*a*) and a second surface (103*b*) separated by a gap (102), wherein the flange (180) of the egg caddy system (100) is placed in the gap (102) and is sandwiched by the first surface (103*a*) and the second surface (103*b*).

The first surface (103*a*) and the second surface (103*b*) may include but are not limited to a countertop, a stove, and a sink. The gap (102) between the two surfaces (103) may be of various sizes, e.g., a width of between about 0.25 and 0.5 inches, between about 0.5 and 1 inch, or more than about 1 inch.

As used herein, the term "about" refers to plus or minus 10% of the referenced number.

The disclosures of the following U.S. Patents are incorporated in their entirety by reference herein: U.S. Pat. No. 1,712,211; U.S. Pat. Application No. 2009/0173256; U.S. Pat. No. 3,748,007; U.S. Pat. No. 5,518,309; U.S. Pat. No. 3,899,161; U.S. Pat. No. 3,446,201; U.S. Pat. No. 2,599,322; U.S. Pat. No. 6,082,841; U.S. Design Pat. No. D356,192; U.S. Pat. No. 7,150,166; U.S. Design Pat. No. D483,228; U.S. Design Pat. No. D211,513.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An egg caddy holding system (500) for holding eggs in an immobilized position, said egg caddy holding system (500) comprising:

(a) an egg caddy system (100) comprising a base (110) having a first end (111), a second end (112), a top surface (115), and a bottom surface (116), the base (110) is generally trapezoidal in shape as viewed from the first end (111) or the second end (112) with the bottom surface (116) having a width greater than that of the top surface (115); a fixed and rigid flange (180) extending downwardly from the bottom surface (116) of the base (110) perpendicularly from the bottom surface (116), the bottom surface (116) of the base (110) and the flange (180) together have a T-shaped cross-section as viewed from the first side (111) or the second side (112) of the base (110); and a plurality of egg protrusions (150) disposed in the top surface (115) of the base (110), the egg protrusions (150) are generally concave and are adapted to temporarily immobilize an egg (101); and (b) a first surface (103*a*) and a second surface (103*b*) separated by a gap (102), wherein the flange (180) of the egg caddy system (100) is disposed in the gap (102) and is sandwiched by the first surface (103*a*) and the second surface (103*b*);

wherein a first side (181*a*) of the flange has a height (as measured to the bottom surface of the base) that is identical to the height of a second side (181*b*) of the flange;

wherein the flange is immovable.

2. The system (100) of claim 1, wherein the first surface (103*a*) and the second surface (103*b*) include a countertop and a stove.

3. The system (100) of claim 1 comprising at least two egg protrusions (150).

4. The system (100) of claim 1 comprising at least four egg protrusions (150).

5. The system (100) of claim 1 comprising at least six egg protrusions (150).

6. The system (100) of claim 1 comprising at least twelve egg protrusions (150).

7. The system (100) of claim 1, wherein the egg protrusions (150) are arranged in two sections aligned parallel to each other.

8. The system (100) of claim 1, wherein the gap (102) is between about 0.25 and 0.5 inches in width.

9. The system (100) of claim 1, wherein the gap (102) is between about 0.5 and 1 inches in width.

10. The system (100) of claim 1, wherein the gap (102) is more than about 1 inch in width.

11. An egg caddy system (100) for holding eggs in an immobilized position, said egg caddy system (100) comprising:

(a) a base (110) having a first end (111), a second end (112), a top surface (115), and a bottom surface (116), the base (110) is generally trapezoidal in shape as viewed from the first end (111) or the second end (112) with the bottom surface (116) having a width greater than that of the top surface (115);

(b) a fixed and rigid flange (180) extending downwardly from the bottom surface (116) of the base (110) perpendicularly from the bottom surface (116), the bottom surface (116) of the base (110) and the flange (180) together have a T-shaped cross-section as viewed from the first side (111) or the second side (112) of the base (110); wherein a first side (181*a*) of the flange has a height (as measured to the bottom surface of the base) that is identical to a height of a second side (181*b*) of the flange; and (c) a plurality of egg protrusions (150) disposed in the top surface (115) of the base (110), the egg protrusions (150) are generally concave and are adapted to temporarily immobilize an egg (101); wherein the flange is immovable.

12. The system (100) of claim 11 wherein the flange is sandwiched between two surfaces.

13. The system (100) of claim 12, wherein the surfaces include a countertop and a stove.

14. The system (100) of claim 11 comprising at least two egg protrusions (150).

15. The system (100) of claim 11 comprising at least four egg protrusions (150).

16. The system (100) of claim 11 comprising at least six egg protrusions (150).

17. The system (100) of claim 11 comprising at least twelve egg protrusions (150).

18. The system (100) of claim 11, wherein the egg protrusions (150) are arranged in two sections aligned parallel to each other.

19. An egg caddy holding system (500) for holding eggs in an immobilized position, said egg caddy holding system (500) consisting of:

(a) an egg caddy system (100) comprising a base (110) having a first end (111), a second end (112), a top surface (115), and a bottom surface (116), the base (110) is generally trapezoidal in shape as viewed from the first end (111) or the second end (112) with the bottom surface (116) having a width greater than that of the top surface (115); a fixed and rigid flange (180) extending downwardly from the bottom surface (116) of the base (110) perpendicularly from the bottom surface (116), the bottom surface (116) of the base (110) and the flange (180) together have a T-shaped cross-section as viewed from the first side (111) or the second side (112) of the base (110); and a plurality of egg protrusions (150) disposed in the top surface (115) of the base (110), the egg protrusions (150) are generally concave and are adapted to temporarily immobilize an egg (101); and (b) a first surface (103*a*) and a second surface (103*b*) separated by a gap (102), wherein the flange (180) of the egg caddy system (100) is disposed in the gap (102) and is sandwiched by the first surface (103*a*) and the second surface (103*b*);

wherein a first side (181*a*) of the flange has a height (as measured to the bottom surface of the base) that is identical to the height of a second side (181*b*) of the flange;

wherein the flange is immovable.

* * * * *